US009353950B2

(12) United States Patent
Uhm et al.

(10) Patent No.: US 9,353,950 B2
(45) Date of Patent: May 31, 2016

(54) SYSTEM FOR REDUCING COMBUSTION DYNAMICS AND $NO_x$ IN A COMBUSTOR

(71) Applicant: General Electric Company, Schenectady, NY (US)

(72) Inventors: Jong Ho Uhm, Simpsonville, SC (US); Willy Steve Ziminsky, Simpsonville, SC (US); Thomas Edward Johnson, Greer, SC (US); Michael John Hughes, Greer, SC (US); William David York, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 660 days.

(21) Appl. No.: 13/709,320

(22) Filed: Dec. 10, 2012

(65) Prior Publication Data

US 2014/0157779 A1 Jun. 12, 2014

(51) Int. Cl.

| | |
|---|---|
| ***F23D 14/62*** | (2006.01) |
| ***F23R 3/28*** | (2006.01) |
| ***F23R 3/10*** | (2006.01) |
| *F23D 14/46* | (2006.01) |
| *F23D 14/58* | (2006.01) |

(52) U.S. Cl.

CPC . *F23R 3/286* (2013.01); *F23R 3/10* (2013.01); *F23D 14/46* (2013.01); *F23D 14/58* (2013.01); *F23D 14/62* (2013.01); *F23R 2900/00014* (2013.01)

(58) Field of Classification Search

CPC ..... F23R 3/286; F23R 2900/00014; F23D 14/46; F23D 14/58; F23D 14/62

See application file for complete search history.

(56) References Cited

U.S. PATENT DOCUMENTS

| | | | | | |
|---|---|---|---|---|---|
| 233,397 | A | | 10/1880 | Bradley | |
| 1,808,120 | A | * | 6/1931 | Runkwitz | 431/284 |
| 2,395,276 | A | * | 2/1946 | Jordan | 431/174 |
| 3,771,500 | A | | 11/1973 | Shakiba | |
| 3,945,574 | A | * | 3/1976 | Polnauer et al. | 239/404 |
| 4,100,733 | A | | 7/1978 | Striebel et al. | |
| 4,104,873 | A | | 8/1978 | Coffinberry | |
| 4,262,482 | A | * | 4/1981 | Roffe et al. | 60/736 |
| 4,404,806 | A | * | 9/1983 | Bell et al. | 60/737 |
| 4,412,414 | A | | 11/1983 | Novick et al. | |
| 4,429,527 | A | | 2/1984 | Teets | |
| 4,610,625 | A | * | 9/1986 | Bunn | 431/284 |
| 4,845,952 | A | | 7/1989 | Beebe | |
| 4,967,561 | A | * | 11/1990 | Bruhwiler et al. | 60/737 |

(Continued)

OTHER PUBLICATIONS

Mohamad Shaiful Ashrul Ishak Mohammad Nazri Mohd. Jaafrar, "The Effect of Swirl Number on Discharge Coefficient for Various Orifice Sizes in a Burner System" Journal Mekanikal, Jun. 2004, Bil. 17, 99-108.

*Primary Examiner* — Lorne Meade

(74) *Attorney, Agent, or Firm* — Dority & Manning, PA

(57) ABSTRACT

A combustor includes an end cap that extends radially across at least a portion of the combustor. The end cap includes an upstream surface axially separated from a downstream surface. A plurality of tubes extend from the upstream surface through the downstream surface of the end cap to provide fluid communication through the end cap. Each tube in a first set of the plurality of tubes has an inlet proximate to the upstream surface and an outlet downstream from the downstream surface. Each outlet has a first portion that extends a different axial distance from the inlet than a second portion.

15 Claims, 7 Drawing Sheets

(56) References Cited

U.S. PATENT DOCUMENTS

| | | | | |
|---|---|---|---|---|
| 5,020,329 | A | 6/1991 | Ekstedt et al. | |
| 5,104,310 | A | 4/1992 | Saltin | |
| 5,205,120 | A | 4/1993 | Oblander et al. | |
| 5,213,494 | A | 5/1993 | Jeppesen | |
| 5,235,814 | A | 8/1993 | Leonard | |
| 5,251,447 | A | 10/1993 | Joshi et al. | |
| 5,341,645 | A | 8/1994 | Ansart et al. | |
| 5,439,532 | A | 8/1995 | Fraas | |
| 5,511,375 | A * | 4/1996 | Joshi et al. | 60/39.463 |
| 5,592,819 | A | 1/1997 | Ansart et al. | |
| 5,603,213 | A | 2/1997 | Sion et al. | |
| 5,685,139 | A | 11/1997 | Mick et al. | |
| 5,707,591 | A | 1/1998 | Semedard et al. | |
| 5,836,164 | A * | 11/1998 | Tsukahara et al. | 60/733 |
| 5,930,999 | A | 8/1999 | Howell et al. | |
| 6,098,407 | A | 8/2000 | Korzendorfer et al. | |
| 6,123,542 | A | 9/2000 | Joshi et al. | |
| 6,301,899 | B1 | 10/2001 | Dean et al. | |
| 6,327,860 | B1 * | 12/2001 | Critchley | 60/737 |
| 6,394,791 | B2 | 5/2002 | Smith et al. | |
| 6,438,961 | B2 | 8/2002 | Tuthill et al. | |
| 6,672,073 | B2 | 1/2004 | Wiebe | |
| 6,796,790 | B2 | 9/2004 | Venizelos et al. | |
| 6,983,600 | B1 | 1/2006 | Dinu et al. | |
| 7,003,958 | B2 | 2/2006 | Dinu et al. | |
| 7,007,478 | B2 | 3/2006 | Dinu | |
| 7,107,772 | B2 | 9/2006 | Chen et al. | |
| 7,266,945 | B2 * | 9/2007 | Sanders | 60/743 |
| 7,343,745 | B2 | 3/2008 | Inoue et al. | |
| 7,426,833 | B2 | 9/2008 | Yoshida et al. | |
| 7,540,154 | B2 | 6/2009 | Tanimura et al. | |
| 7,631,499 | B2 | 12/2009 | Bland | |
| 7,721,547 | B2 | 5/2010 | Bancalari et al. | |
| 7,732,899 | B1 | 6/2010 | Berry et al. | |
| 7,752,850 | B2 | 7/2010 | Laster et al. | |
| 7,775,792 | B2 * | 8/2010 | De Boni et al. | 431/279 |
| 7,827,797 | B2 * | 11/2010 | Han et al. | 60/746 |
| 7,886,991 | B2 | 2/2011 | Zuo et al. | |
| 8,007,274 | B2 | 8/2011 | Johnson et al. | |
| 8,104,284 | B2 | 1/2012 | Miura et al. | |
| 8,112,999 | B2 | 2/2012 | Zuo | |
| 8,141,334 | B2 | 3/2012 | Johnson et al. | |
| 8,147,121 | B2 | 4/2012 | Lacey et al. | |
| 8,157,189 | B2 | 4/2012 | Johnson et al. | |
| 8,181,891 | B2 | 5/2012 | Ziminsky et al. | |
| 8,261,555 | B2 * | 9/2012 | Uhm et al. | 60/746 |
| 8,424,311 | B2 * | 4/2013 | York | F23R 3/286 60/737 |
| 8,733,108 | B2 * | 5/2014 | Kim et al. | 60/776 |
| 8,904,798 | B2 * | 12/2014 | Manoharan et al. | 60/737 |
| 9,010,083 | B2 * | 4/2015 | Uhm et al. | 60/39.463 |
| 2004/0216463 | A1 | 11/2004 | Harris | |
| 2005/0050895 | A1 | 3/2005 | Dorr et al. | |
| 2008/0016876 | A1 | 1/2008 | Colibaba-Evulet et al. | |
| 2008/0302105 | A1 | 12/2008 | Oda et al. | |
| 2008/0304958 | A1 | 12/2008 | Norris et al. | |
| 2009/0061369 | A1 * | 3/2009 | Wang et al. | 431/114 |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0087394 | A1 | 4/2010 | Twydell | |
| 2010/0089367 | A1 | 4/2010 | Johnson et al. | |
| 2010/0095676 | A1 | 4/2010 | Uhm et al. | |
| 2010/0101229 | A1 | 4/2010 | York et al. | |
| 2010/0139280 | A1 | 6/2010 | Lacey et al. | |
| 2010/0180600 | A1 | 7/2010 | Lacey et al. | |
| 2010/0186413 | A1 | 7/2010 | Lacey et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2011/0265482 | A1 | 11/2011 | Parsania et al. | |
| 2012/0006030 | A1 | 1/2012 | Uhm et al. | |
| 2012/0079829 | A1 | 4/2012 | Berry et al. | |
| 2012/0180487 | A1 * | 7/2012 | Uhm et al. | 60/737 |
| 2013/0104556 | A1 * | 5/2013 | Uhm et al. | 60/772 |
| 2015/0050605 | A1 * | 2/2015 | Desi-Seulean et al. | 431/9 |

* cited by examiner

SYSTEM FOR REDUCING COMBUSTION DYNAMICS AND $NO_x$ IN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a combustor such as may be incorporated into a gas turbine or other turbomachine.

BACKGROUND OF THE INVENTION

Combustors are commonly used in industrial and power generation operations to ignite fuel to produce combustion gases having a high temperature and pressure. For example, turbo-machines such as gas turbines typically include one or more combustors to generate power or thrust. A typical gas turbine includes an inlet section, a compressor section, a combustion section, a turbine section, and an exhaust section. The inlet section cleans and conditions a working fluid (e.g., air) and supplies the working fluid to the compressor section. The compressor section increases the pressure of the working fluid and supplies a compressed working fluid to the combustion section. The combustion section mixes fuel with the compressed working fluid and ignites the mixture to generate combustion gases having a high temperature and pressure. The combustion gases flow to the turbine section where they expand to produce work. For example, expansion of the combustion gases in the turbine section may rotate a shaft connected to a generator to produce electricity.

The combustion section may include one or more combustors annularly arranged between the compressor section and the turbine section, and various parameters influence the design and operation of the combustors. For example, higher combustion gas temperatures generally improve the thermodynamic efficiency of the combustor. However, higher combustion gas temperatures also promote flame holding conditions in which the combustion flame migrates towards the fuel being supplied by nozzles, possibly causing accelerated damage to the nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, the combustor may include an end cap that extends radially across at least a portion of the combustor. A plurality of tubes may be radially arranged in one or more tube bundles across the end cap to provide fluid communication for the compressed working fluid through the end cap and into a combustion chamber. Fuel supplied to a fuel plenum inside the end cap may flow around the tubes and provide convective cooling to the tubes before flowing across a baffle and into the tubes. The fuel and compressed working fluid mix inside the tubes before flowing out of the tubes and into the combustion chamber.

Although effective at enabling higher operating temperatures while protecting against flame holding and controlling undesirable emissions, some fuels and operating conditions may produce very high frequencies in the combustor. Increased vibrations in the combustor associated with high frequencies may reduce the useful life of one or more combustor components. Alternately, or in addition, high frequencies of combustion dynamics may produce pressure pulses inside the tubes and/or the combustion chamber that may adversely affect the stability of the combustion flame, reduce the design margins for flame holding, and/or increase undesirable emissions. Therefore, a system that adjusts resonant frequencies in the combustor would be useful to enhancing the thermodynamic efficiency of the combustor, protecting the combustor from accelerated wear, promoting flame stability, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a combustor that includes an end cap that extends radially across at least a portion of the combustor. The end cap includes an upstream surface axially separated from a downstream surface. A plurality of tubes extend from the upstream surface through the downstream surface of the end cap to provide fluid communication through the end cap. Each tube in a first set of the plurality of tubes has an inlet proximate to the upstream surface and an outlet downstream from the downstream surface. Each outlet has a first portion that extends a different axial distance from the inlet than a second portion.

Another embodiment of the present invention is a combustor that includes an end cap that extends radially across at least a portion of the combustor. The end cap includes an upstream surface axially separated from a downstream surface. A first tube bundle extends radially across at least a portion of the end cap to provide fluid communication through the end cap. A first plurality of tubes in the first tube bundle extend downstream from the downstream surface. Each tube in the first plurality of tubes has a first inlet proximate to the upstream surface and a first outlet downstream from the downstream surface. Each first outlet has a first portion that extends a different axial distance from the first inlet than a second portion. A second tube bundle extends radially across at least a portion of the end cap to provide fluid communication through the end cap. A second plurality of tubes in the second tube bundle extend downstream from the downstream surface. Each tube in the second plurality of tubes has a second inlet proximate to the upstream surface and a second outlet downstream from the downstream surface. Each second outlet has a third portion that extends a different axial distance from the second inlet than a fourth portion.

The present invention may also include a gas turbine having a compressor, a combustor downstream from the compressor, and a turbine downstream from the combustor. An end cap extends radially across at least a portion of the combustor and includes an upstream surface axially separated from a downstream surface. A combustion chamber is downstream from the end cap. A plurality of tubes extend from the upstream surface through the downstream surface of the end cap to provide fluid communication through the end cap. Each tube has an outlet downstream from the downstream surface with a first portion that extends a different axial distance into the combustion chamber than a second portion.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
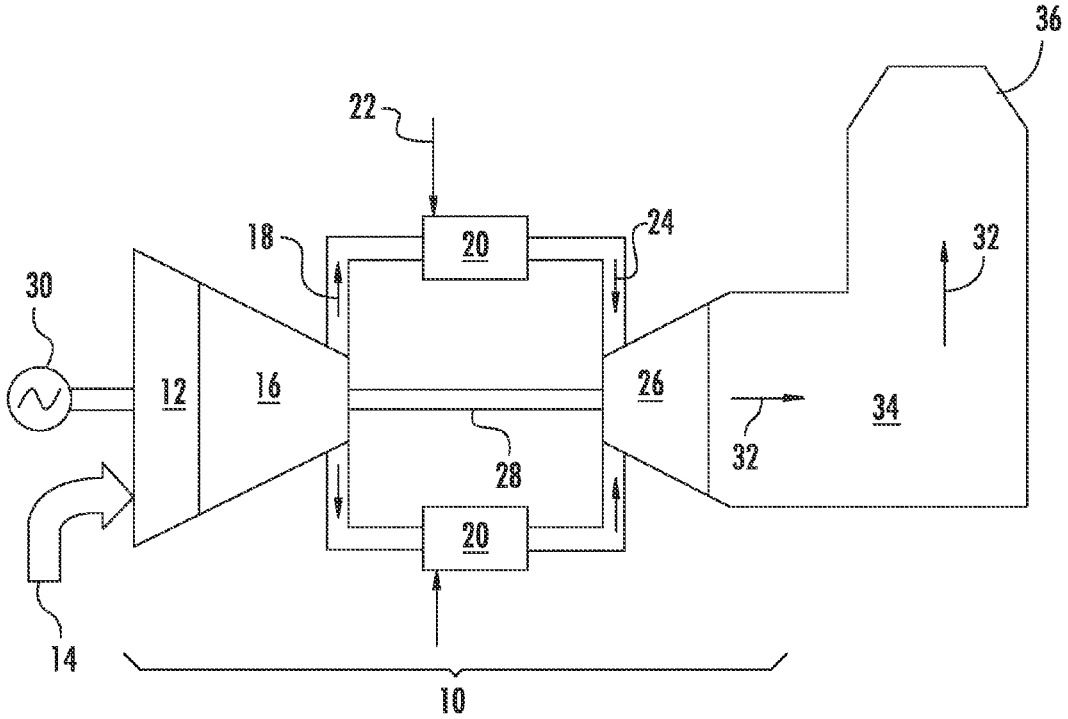
FIG. 1 is a functional block diagram of an exemplary gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor that reduces combustion dynamics while enhancing the thermodynamic efficiency, promoting flame stability, and/or reducing undesirable emissions over a wide range of combustor operating levels. In general, an end cap may extend radially across at least a portion of the combustor, and a plurality of tubes radially arranged across the end cap may provide fluid communication through the end cap to a combustion chamber downstream from the end cap. Each tube has an inlet proximate to an upstream surface of the end cap and an outlet through a downstream surface of the end cap. In particular embodiments, the outlet for one or more tubes may extend downstream from the downstream surface and may be sloped, tapered, and/or stepped to vary the shape, position, and/or vortex shedding associated with the flame in the combustion chamber. The different lengths and/or shapes of the outlets may decouple the natural frequency of the combustion dynamics, reduce flow instabilities, and/or axially distribute the combustion flame across the downstream surface of the end cap. As a result, various embodiments of the present invention may allow extended combustor operating conditions, extend the life and/or maintenance intervals for various combustor components, maintain adequate design margins of flame holding, and/or reduce undesirable emissions. Although exemplary embodiments of the present invention will be described generally in the context of a combustor incorporated into a gas turbine for purposes of illustration, one of ordinary skill in the art will readily appreciate that embodiments of the present invention may be applied to any combustor incorporated into any turbo-machine and are not limited to a gas turbine combustor unless specifically recited in the claims.

Referring now to the drawings, wherein identical numerals indicate the same elements throughout the figures, FIG. 1 provides a functional block diagram of an exemplary gas turbine 10 that may incorporate various embodiments of the present invention. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18 at a highly energized state. The compressed working fluid 18 flows to a combustion section where one or more combustors 20 ignite fuel 22 with the compressed working fluid 18 to produce combustion gases 24 having a high temperature and pressure. The combustion gases 24 flow through a turbine section to produce work. For example, a turbine 26 may connect to a shaft 28 so that rotation of the turbine 26 drives the compressor 16 to produce the compressed working fluid 18. Alternately or in addition, the shaft 28 may connect the turbine 26 to a generator 30 for producing electricity. Exhaust gases 32 from the turbine 26 flow through an exhaust section 34 that may connect the turbine 26 to an exhaust stack 36 downstream from the turbine 26. The exhaust section 34 may include, for example, a heat recovery steam generator (not shown) for cleaning and extracting additional heat from the exhaust gases 32 prior to release to the environment.

Figure 2:
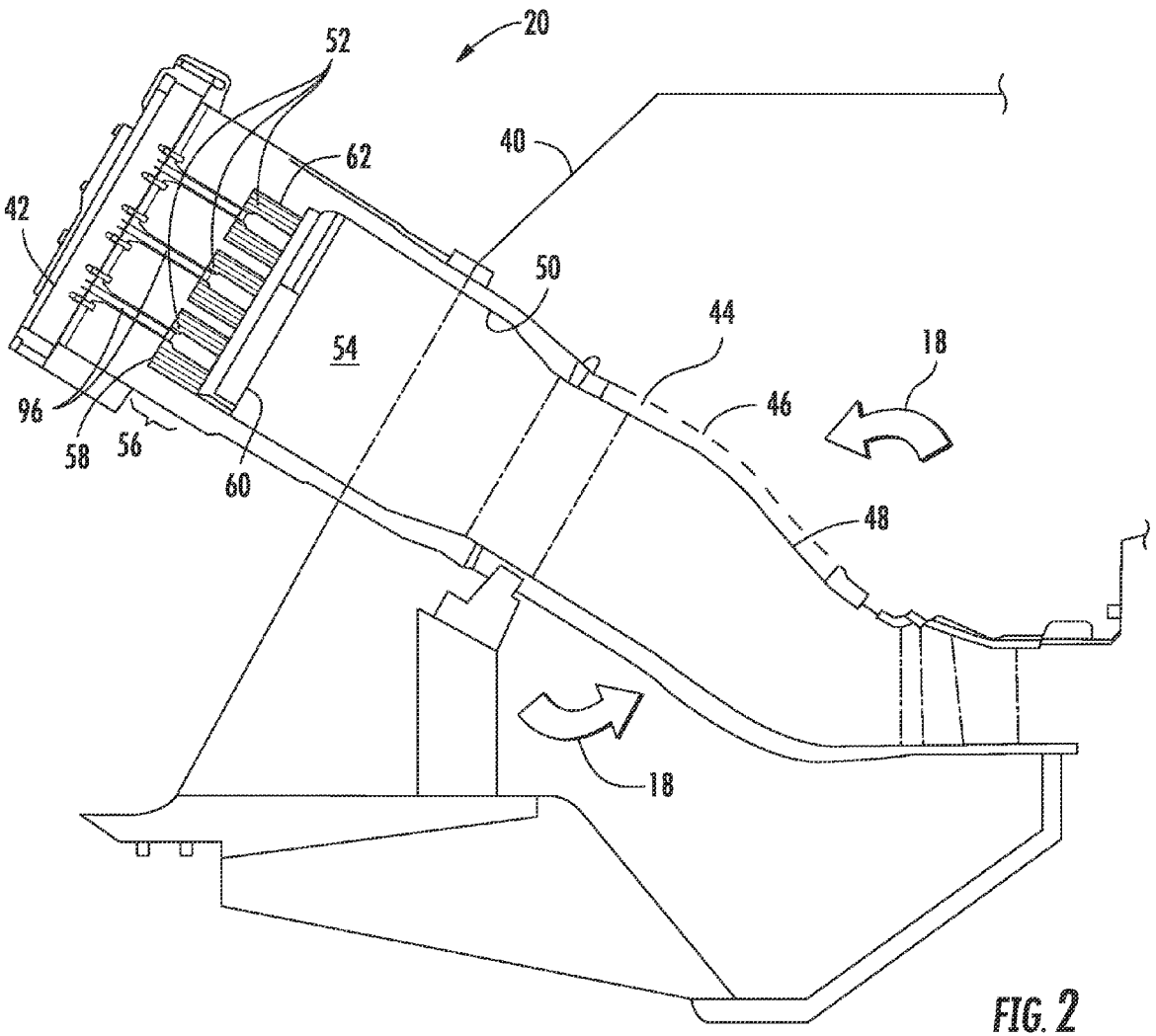
FIG. 2 is a simplified side cross-section view of an exemplary combustor according to various embodiments of the present invention.
Figure 3:
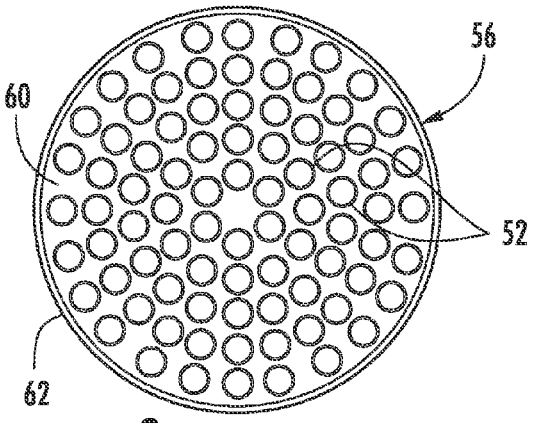
FIG. 3 is an upstream view of the end cap shown in FIG. 2 according to an embodiment of the present invention.

The combustors 20 may be any type of combustor known in the art, and the present invention is not limited to any particular combustor design unless specifically recited in the claims. FIG. 2 provides a simplified side cross-section view of an exemplary combustor 20 according to various embodiments of the present invention. As shown in FIG. 2, a casing 40 and an end cover 42 may combine to contain the compressed working fluid 18 flowing to the combustor 20. The compressed working fluid 18 may pass through flow holes 44 in an impingement sleeve 46 to flow along the outside of a transition piece 48 and liner 50 to provide convective cooling to the transition piece 48 and liner 50. When the compressed working fluid 18 reaches the end cover 42, the compressed working fluid 18 reverses direction to flow through a plurality of tubes 52 into a combustion chamber 54.

The tubes 52 are radially arranged in an end cap 56 upstream from the combustion chamber 54. As shown, the end cap 56 generally extends radially across at least a portion of the combustor 20 and may include an upstream surface 58 axially separated from a downstream surface 60. A cap shield or shroud 62 may circumferentially surround the upstream and downstream surfaces 58, 60. Each tube 52 may extend from the upstream surface 58 and/or through the downstream surface 60 of the end cap 56 to provide fluid communication for the compressed working fluid 18 to flow through the end cap 56 and into the combustion chamber 54.

Figure 4:
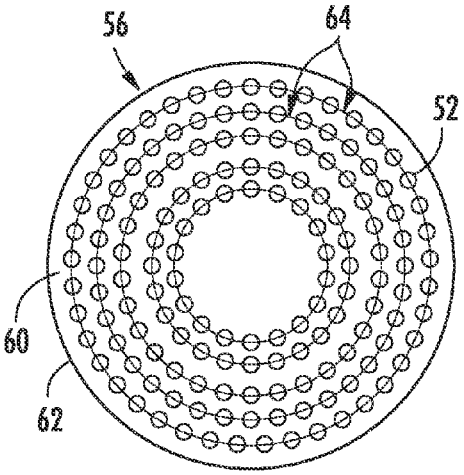
FIG. 4 is an upstream view of the end cap shown in FIG. 2 according to an alternate embodiment of the present invention.
Figure 5:
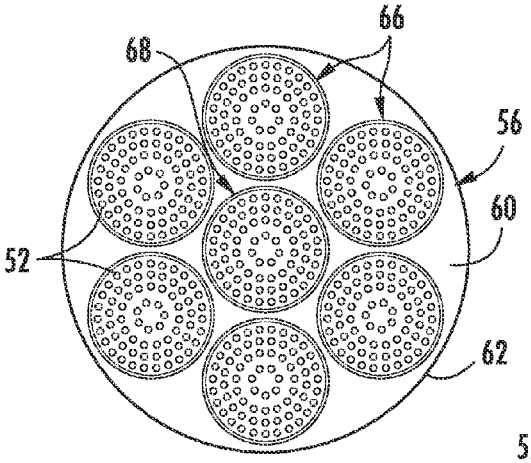
FIG. 5 is an upstream view of the end cap shown in FIG. 2 according to an alternate embodiment of the present invention.
Figure 6:
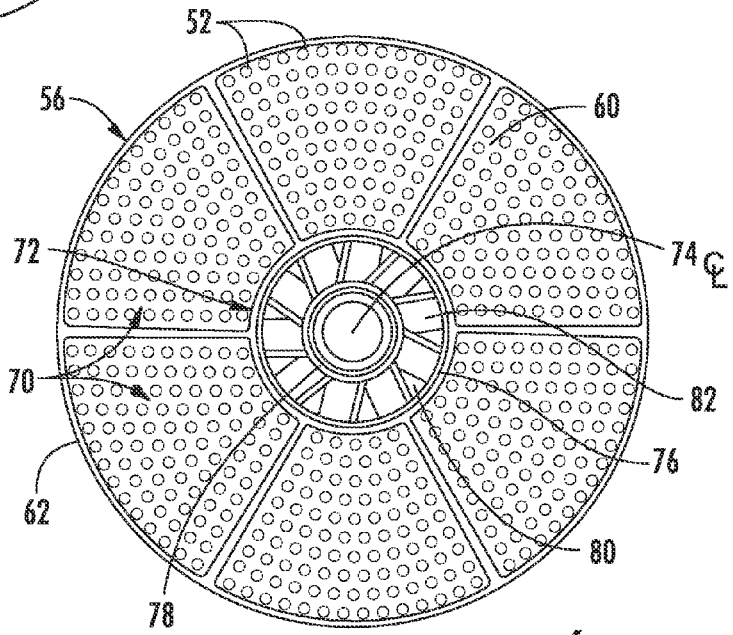
FIG. 6 is an upstream view of the end cap shown in FIG. 2 according to an alternate embodiment of the present invention.

Various embodiments of the combustor 20 may include different numbers, shapes, and arrangements of tubes 52 separated into various bundles across the end cap 56, and FIGS. 3-6 provide upstream views of the end cap 56 according to various exemplary embodiments. Although generally illustrated as cylindrical tubes in each embodiment, the cross-section of the tubes 52 may be any geometric shape, and the present invention is not limited to any particular cross-section unless specifically recited in the claims. The tubes 52 in each bundle may be grouped in circular, triangular, square, or other geometric shapes, and the bundles may be arranged in various numbers and geometries in the end cap 56. For example, in the embodiment shown in FIG. 3, the tubes 52 are radially arranged across the end cap 56 as a single tube bundle. In contrast, FIGS. 4-6 show the tubes 52 arranged in multiple tube bundles that may facilitate different operating levels and/or different fuels 22. In FIG. 4, for example, the tubes 52 may be arranged in substantially concentric tube bundles 64, with each concentric tube bundle 64 potentially receiving a different fuel 22 or fuel flow. Alternately, as shown in FIG. 5, the tubes 52 may be arranged in six outer tube bundles 66 radially surrounding a single center tube bundle 68. In the particular embodiment shown in FIG. 6, the tubes 52 may be arranged in six pie-shaped tube bundles 70 that circumferentially surround a single fuel nozzle 72 aligned with an axial centerline 74 of the end cap 56. The fuel nozzle 72 may include, for example, a shroud 76 that circumferentially surrounds a center body 78 to define an annular passage 80 between the shroud 76 and the center body 78. One or more swirler vanes 82 may be located between the shroud 76 and the center body 78 to impart swirl to the compressed working fluid 18 flowing through the annular passage 80. In this manner, the fuel nozzle 72 may provide fluid communication through the end cap 56 to the combustion chamber 54 separate and apart from the tubes 52. One of ordinary skill in the art will readily appreciate multiple other shapes and arrangements for the tube bundles from the teachings herein, and the particular shape and arrangement of the tube bundles is not a limitation of the present limitation unless specifically recited in the claims.

FIGS. 7-10 provide side cross-section views of an exemplary tube bundle 90 according to various embodiments within the scope of the present invention. As shown in each figure, the tube bundle 90 generally extends radially across at least a portion of the end cap 56, and the tubes 52 extend axially between the upstream and downstream surfaces 58, 60 to provide fluid communication for the compressed working fluid 18 to flow through the tube bundle 90 and into the combustion chamber 54. Specifically, each tube 52 includes an inlet 92 proximate to the upstream surface 58 and an outlet 94 downstream from the downstream surface 60.

The upstream surface 58, downstream surface 60, and shroud 62 generally define a fuel plenum 96 inside the tube bundle 90, and a baffle 98 may extend radially between the upstream and downstream surfaces 58, 60 to axially divide the fuel plenum 96 inside the end cap 56. Specifically, the upstream surface 58, shroud 62, and baffle 98 may enclose or define an upper fuel plenum 100 around the upper portion of the tubes 52, and the downstream surface 60, shroud 62, and baffle 98 may enclose or define a lower fuel plenum 102 around the lower portion of the tubes 52.

A conduit 104 may extend through the upstream surface 58 or shroud 62 of the end cap 56 to provide fluid communication for fuel 22, diluents, and/or other additives to flow into the fuel plenum 96. The fuel 22, diluent, and/or other additives may flow around the tubes 52 in the lower fuel plenum 102 to provide convective cooling to the tubes 52 and pre-heat the fuel 22. The fuel 22 may then flow through holes or gaps 106 in the baffle 98 and into the upper fuel plenum 100. Once in the upper fuel plenum 100, the fuel 22 may flow through fuel ports 108 in one or more tubes 52 to mix with the compressed working fluid 18 inside the tubes 52 before flowing into the combustion chamber 54. The fuel ports 108 may be angled radially, axially, and/or azimuthally to project and/or impart swirl to the fuel 22 flowing through the fuel ports 108 and into the tubes 52. In this manner, the compressed working fluid 18 may flow into the tubes 52, and the fuel 22 from the upper fuel plenum 100 may flow through the fuel ports 108 and into the tubes 52 to mix with the compressed working fluid 18.

As the fuel-working fluid mixture flows through the tubes 52 and into the combustion chamber 54, the flames of adjacent tubes 52 may interact with one another produce very high frequencies, flow oscillations, and/or vibrations in the combustor 20. For each embodiment shown in FIGS. 7-10, the tube bundle 90 includes one or more tubes 52 that have a first portion 110 that extends a different axial distance 112 from the inlet 92 than a second portion 114. In particular embodiments, for example, the outlets 94 for one or more tubes 52 may be sloped, tapered, and/or stepped to vary the shape, position, and/or vortex shedding associated with the flame in the combustion chamber 54. As a result, the first and second portions 110, 114 extend different axial distances 112 into the combustion chamber 54 to decouple the natural frequency of the combustion dynamics, reduce flow instabilities, and/or axially distribute the combustion flame across the downstream surface 60 of the end cap 56.

Figure 7:
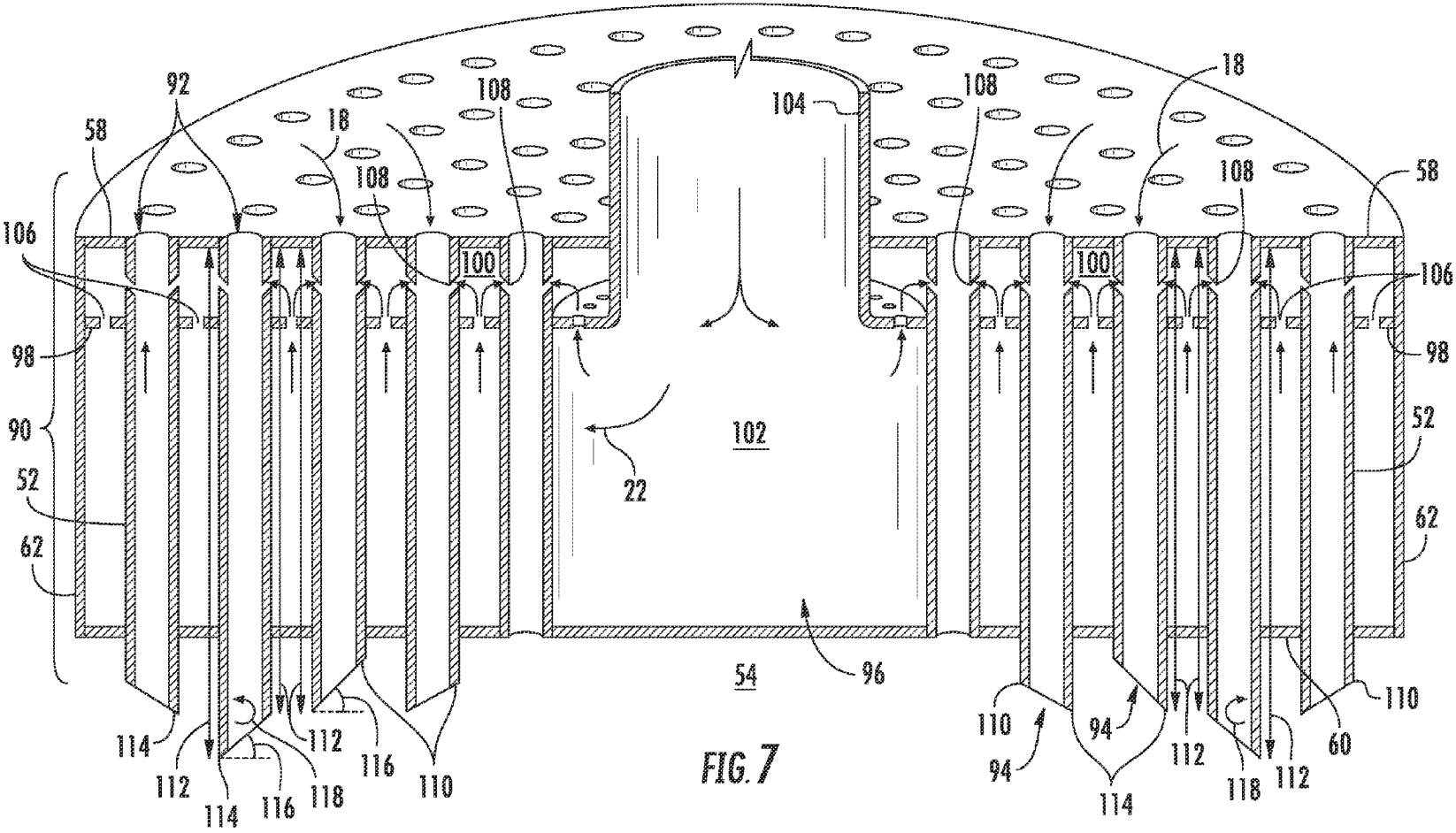
FIG. 7 is a side cross-section view of a tube bundle according to an embodiment of the present invention.

In the particular embodiment shown in FIG. 7, the outlets 94 for some of the tubes 52 coincide with the downstream surface 60, while the outlets 94 for other tubes 52 extend downstream from the downstream surface 60. For the outlets 94 that extend downstream from the downstream surface 60, the first portion 110 extends a different axial distance 112 from the inlet 92 than the second portion 114 so that each outlet 94 is sloped continuously from the first portion 110 to the second portion 114. As shown in FIG. 7, the difference in the axial distance 112 between the first portion 110 and the inlet 92 and/or the second portion 114 and the inlet 92 may be varied between the tubes 52 to produce tubes 52 having different overall lengths as well as tubes 52 having different slope angles 116. Alternately, or in addition, the tubes 52 may be rotated to change a rotational angle 118 between the tubes 52. For example, the rotational angles 118 may be selected so that each outlet 94 is sloped upstream or downstream, as desired, from the outer perimeter of the end cap 56. The various combinations of the different axial distances 112, slope angles 116, and/or rotational angles 118 produce slightly different convection times for the fuel 22 and compressed working fluid 18 flowing through each tube 52. The slightly different convection times and varying axial positions of the outlets 94 may thus reduce interaction between adjacent flames to decouple the natural frequency of the combustion dynamics, tailor flow instabilities downstream from the downstream surface 60, and/or axially distribute the combustion flame across the downstream surface 60 of the tubes 52 to reduce $NO_X$ production during base load operations.

Figure 8:
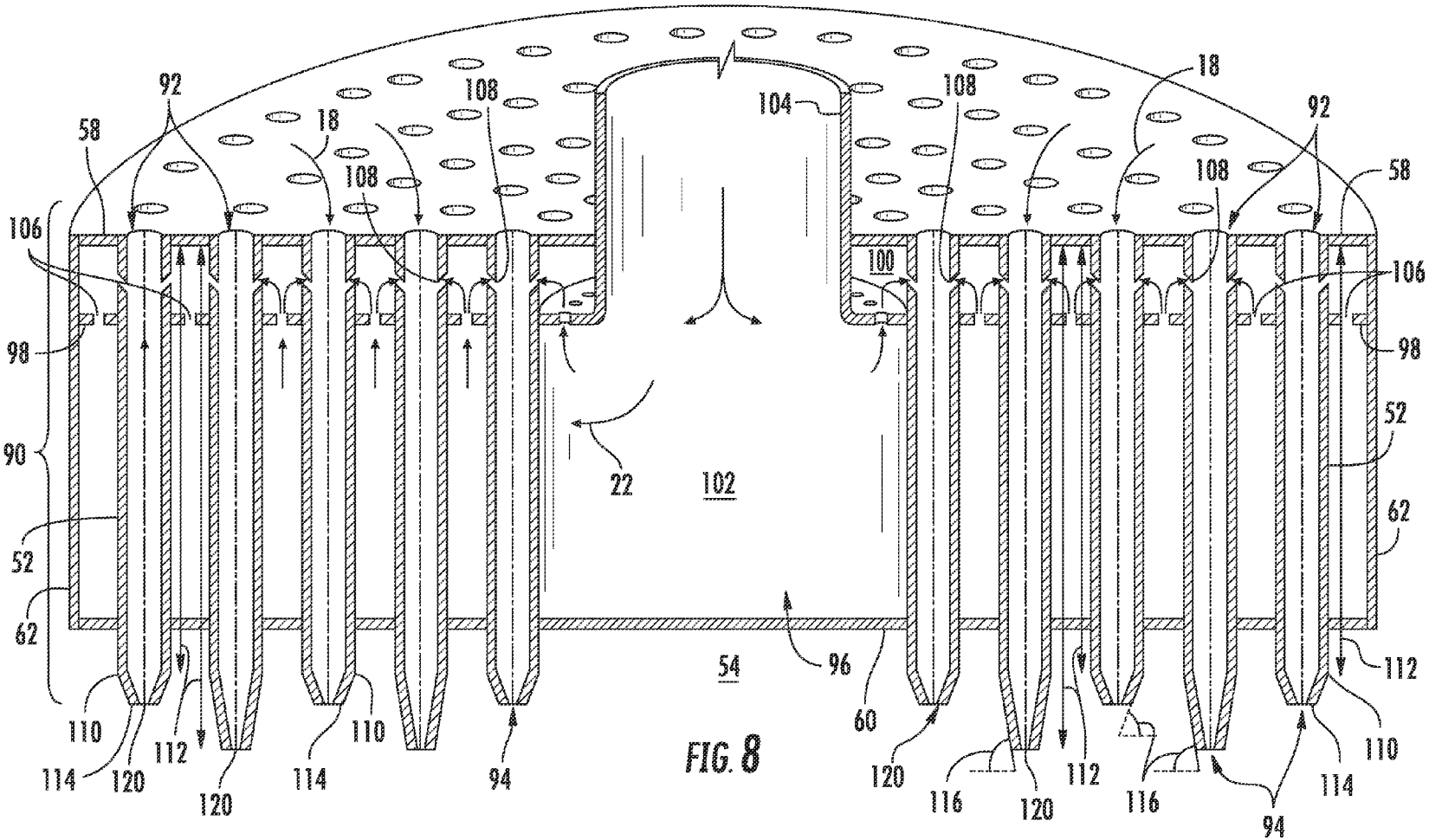
FIG. 8 is a side cross-section view of a tube bundle according to an alternate embodiment of the present invention.

In the particular embodiment shown in FIG. 8, the outlets 94 for all of the tubes 52 extend downstream from the downstream surface 60, and the first portion again 110 extends a different axial distance 112 from the inlet 92 than the second portion 114. In addition, each outlet 94 is tapered so that the second portion 114 forms an apex 120 in the combustion chamber 54. As shown in FIG. 8, the difference in the axial distance 112 between the first portion 110 and the inlet 92 and/or the second portion 114 and the inlet 92 may be varied between the tubes 52 to produce tubes 52 having different overall lengths as well as tubes 52 having different slope angles 116. Although the slope angles 116 are symmetrical in FIG. 8 (i.e., the slope angle 116 on each side of the apex 120 is the same), in other particular examples, the slope angles 116 may be asymmetrical (i.e., the slope angle 116 on each side of the apex 120 may be different) and/or the tubes 52 may be rotated to change the rotational angles 118 between the tubes 52. The various combinations of the different axial distances 112, slope angles 116, and/or rotational angles 118 again produce slightly different convection times for the fuel 22 and compressed working fluid 18 flowing through each tube 52 to reduce interaction between adjacent flames and decouple the natural frequency of the combustion dynamics.

Figure 9:
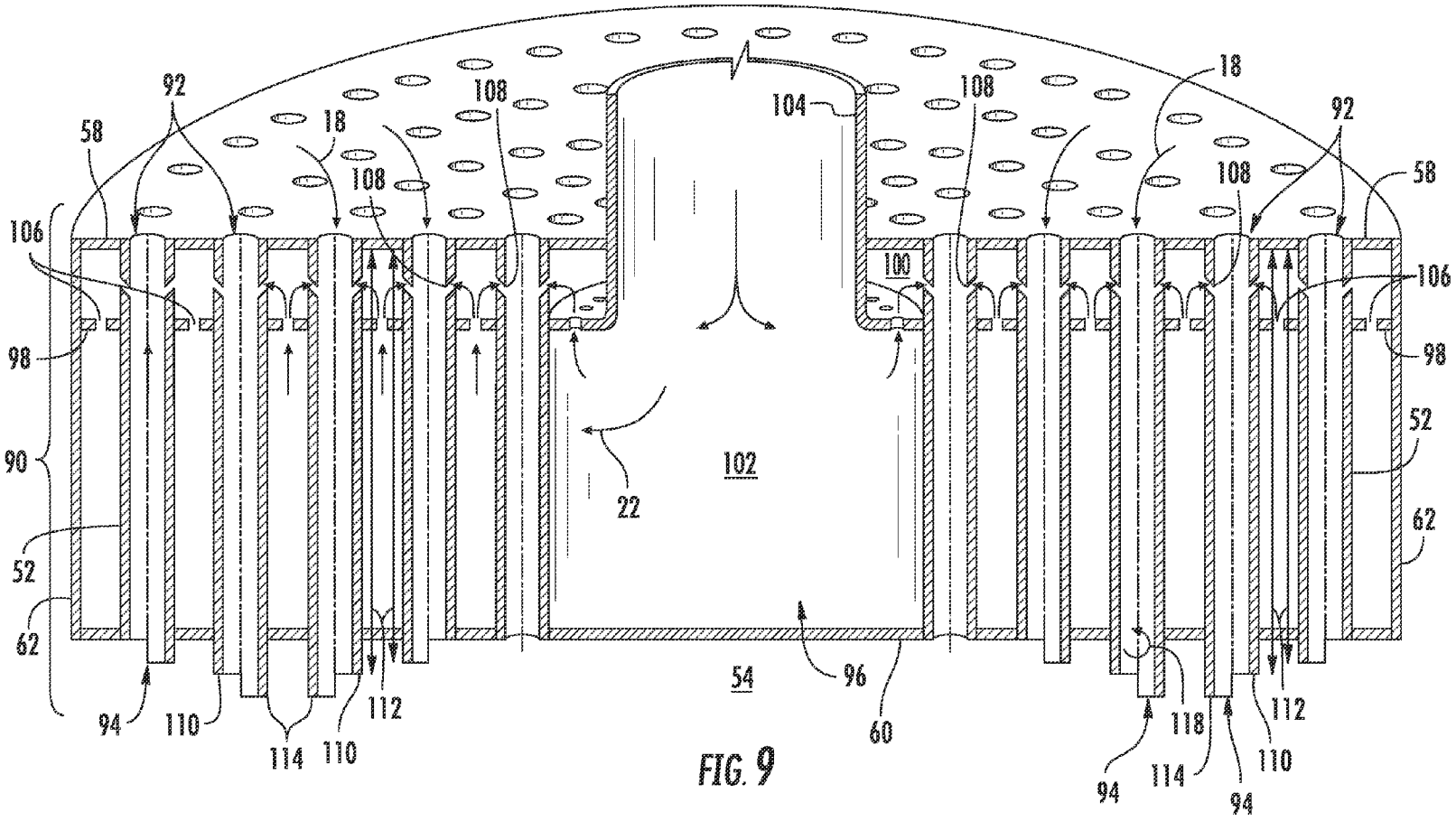
FIG. 9 is a side cross-section view of a tube bundle according to an alternate embodiment of the present invention.

In the particular embodiment shown in FIG. 9, the outlet 94 for one tube 52 coincides with the downstream surface 60, while the outlets 94 for other tubes 52 extend at least partially downstream from the downstream surface 60. For the outlets 94 that extend at least partially downstream from the downstream surface 60, the first portion again 110 extends a different axial distance 112 from the inlet 92 than the second portion 114 so that the outlets 94 are stepped to vary the axial position of the flame in the combustion chamber 54. In particular embodiments, the width of the step may be varied between tubes 52. Alternately, or in addition, the tubes 52 may be rotated to change the rotational angles 118 between the tubes 52. For example, the rotational angles 118 may be selected so that each outlet 94 is stepped upstream or downstream, as desired, from the outer perimeter of the end cap 56. The various combinations of the different axial distances 112, width of each step, and/or the rotational angles 118 between the tubes 52 again produce slightly different convection times for the fuel 22 and compressed working fluid 18 flowing through each tube 52 to reduce interaction between adjacent flames and decouple the natural frequency of the combustion dynamics.

Figure 10:
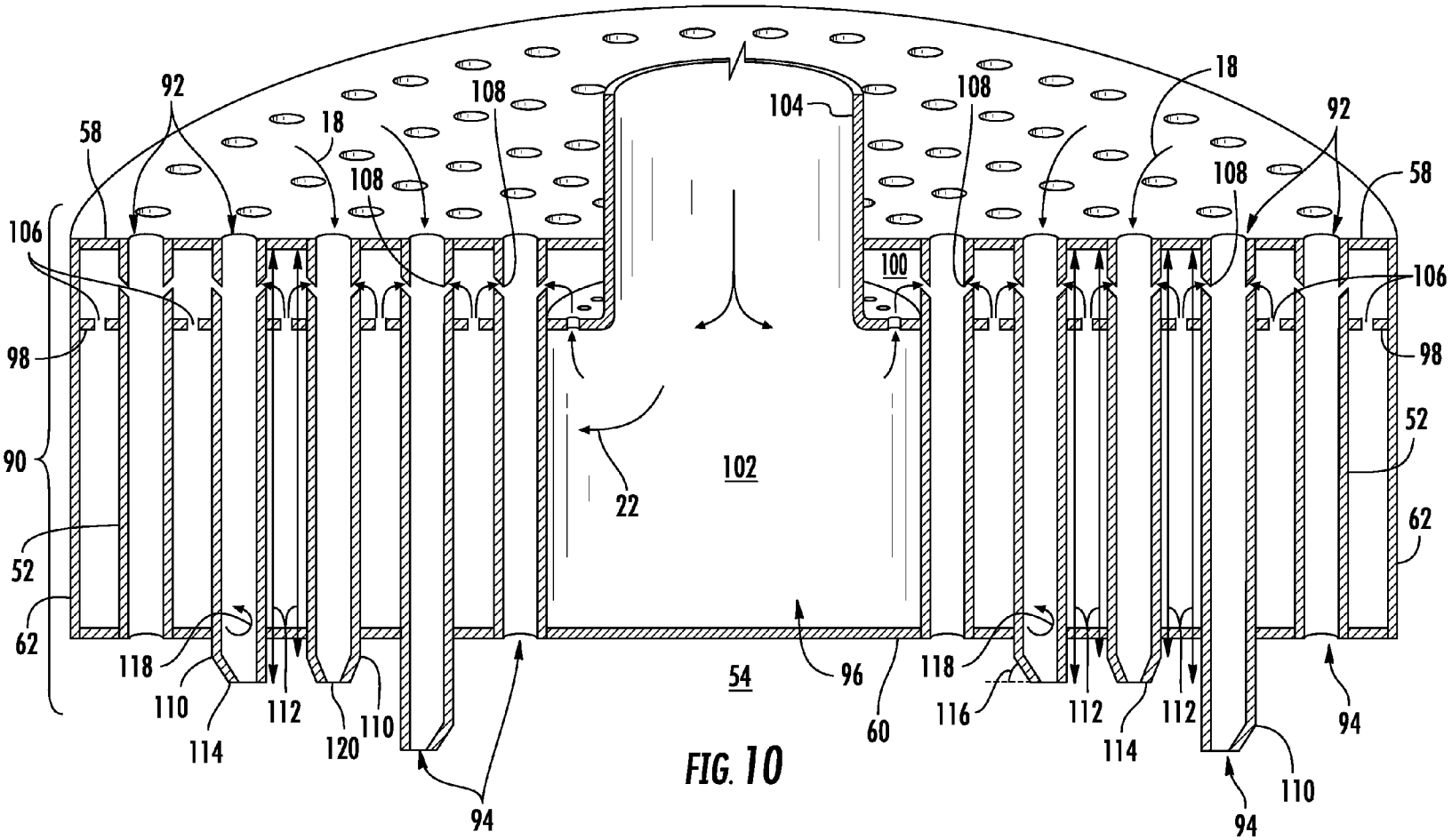
FIG. 10 is a side cross-section view of a tube bundle according to an alternate embodiment of the present invention.

In the particular embodiment shown in FIG. 10, the outlets 94 for some of the tubes 52 coincide with the downstream surface 60, while the outlets 94 for other tubes 52 extend at least partially downstream from the downstream surface 60. For the outlets 94 that extend downstream from the downstream surface 60, the first portion 110 extends a different axial distance 112 from the inlet 92 than the second portion 114 to form tapered outlets 94. As shown in FIG. 10, the taper may be on one or both sides of the outlets 94, and the slope angle 116 and/or rotational angle 118 of the taper may vary between tubes 52. The various combinations of the different axial distances 112, slope angles 116, and/or rotational angles 118 between the tubes 52 again produce slightly different convection times for the fuel 22 and compressed working fluid 18 flowing through each tube 52 to reduce interaction between adjacent flames and decouple the natural frequency of the combustion dynamics.

One of ordinary skill in the art will readily appreciate from the teachings herein that the various sloped, stepped, and tapered outlets 94 shown in FIGS. 7-10 may be varied between tube bundles 90 and/or between tubes 52 in each tube bundle 90, as desired. For example, referring back to the upstream view of the end cap 56 shown in FIG. 3, the tubes 52 in the end cap 56 may have various combinations of the sloped, stepped, and/or tapered outlets 94 shown in FIGS. 7-10. As another example, one concentric tube bundle 64 shown in FIG. 4 may have sloped outlets 94 as shown in FIG. 7, a second concentric tube bundle 64 may have tapered outlets as shown in FIGS. 8 and/or 10, and a third concentric tube bundle may have stepped outlets 94 as shown in FIG. 9. In addition, the rotational angle 118 for the tubes 52 may be varied between each tube 52 and/or between each concentric tube bundle 64 to further reduce interaction between adjacent flames. As yet another example, the outer tube bundles 66, 70 shown in FIGS. 5 and 6 may alternate between various sloped outlets 94 as shown in FIG. 7 and various tapered outlets 94 as shown in FIGS. 8 and/or 10, with the rotational angle 118 varied between each tube 52 and/or between each tube bundle 66, 70.

The various embodiments described and illustrated with respect to FIGS. 1-10 may provide one or more advantages over existing nozzles and combustors. For example, the various combinations of axial distances 112, slope angles 116, and/or rotational angles 118 between each tube 52 and/or tube bundle 90 may decouple the natural frequency of the combustion dynamics, tailor flow instabilities, and/or axially distribute the combustion flame across the downstream surface 60 of the tubes 52 to reduce $NO_X$ production during base load operations and/or carbon monoxide and other unburned hydrocarbon production during turndown operations.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor comprising:

an outer casing;

an end cap assembly disposed within the outer casing, the end cap assembly having an upstream surface defined by an upstream plate, a downstream surface defined by a downstream plate axially spaced from the upstream plate and a shroud that extends axially between the upstream plate and the downstream plate, the upstream plate, the downstream plate and the shroud at least partially defining a fuel plenum within the end cap assembly;

wherein the end cap assembly further comprises a plurality of tubes, each tube extending from the upstream plate, through the fuel plenum and through the downstream plate, each tube having a fuel port in fluid communication with the fuel plenum and an inlet defined along the upstream surface;

wherein the plurality of tubes comprises a first tube and a second tube, the first tube having an outlet defined at a downstream end of the first tube and the second tube having an outlet defined at a downstream end of the second tube, wherein the downstream end of the first tube is axially offset from the downstream end of the second tube with respect to an axial centerline of the end cap assembly; and wherein the first tube converges radially inwardly between the downstream surface and the downstream end of the first tube, wherein the downstream end of the second tube has a first portion and a second portion, wherein the second portion converges radially inwardly between the downstream surface and the downstream end of the second tube along an axial centerline of the second tube while the first portion extends axially along the centerline of the second tube.

2. The combustor as in claim 1, further comprising a third tube having an outlet defined at a downstream end of the third tube, wherein the downstream end of the third tube terminates at the downstream surface so that the outlet of the third tube coincides with the downstream surface and the downstream end of the second tube terminates at a point that is axially offset from the downstream surface.

3. The combustor as in claim 1, wherein the downstream end of the first tube and the downstream end of the second tube are axially offset from the downstream surface.

4. The combustor as in claim 1, further comprising a third tube having an axial centerline parallel to the axial centerline of the end cap assembly, a downstream end of the third tube having an outlet sloped at an acute angle to the axial centerline of the third tube.

5. The combustor as in claim 1, further comprising a third tube, wherein a downstream end of a third tube has a first portion and a second portion, wherein the first portion is axially offset from the second portion to form a stepped outlet of the third tube.

6. The combustor as in claim 1, further comprising a third tube and a fourth tube, the third tube having an outlet defined at a downstream end of the third tube, wherein the downstream end of the third tube terminates at the downstream surface so that the outlet of the third tube coincides with the downstream surface and a downstream end of the fourth tube has a first portion and a second portion, wherein the first portion is axially offset from the second portion to form a stepped outlet of the fourth tube.

7. The combustor as in claim 1, further comprising a third tube, wherein the third tube converges radially inwardly between the downstream surface and a downstream end of the third tube.

8. The combustor as in claim 1, wherein the plurality of tubes includes a first set of tubes annularly arranged around the axial centerline of the end cap assembly and a second set of tubes annularly arranged around the first set of tubes, wherein the first set of tubes includes the first tube and the second set of tubes includes the second tube.

9. A gas turbine, comprising:

a compressor;

a combustor having a combustion chamber downstream from the compressor;

a turbine downstream from the combustor;

an end cap assembly disposed within the combustor upstream from the combustion chamber, the end cap assembly having an upstream surface defined by an upstream plate, a downstream surface defined by a downstream plate and a shroud that extends axially between the upstream plate and the downstream plate, the upstream plate, the downstream plate and the shroud at least partially defining a fuel plenum within the end cap assembly;

wherein the end cap assembly further comprises a first plurality of tubes annularly arranged about an axial centerline of the end cap assembly, each tube of the first plurality of tubes extending from the upstream plate, through the fuel plenum and through the downstream plate, each tube having a fuel port in fluid communication with the fuel plenum, an inlet defined proximate to the upstream surface and an outlet defined at a downstream end of each tube;

wherein the end cap assembly further comprises a second plurality of tubes annularly arranged about the first plurality of tubes, each tube of the second plurality of tubes extending from the upstream plate, through the fuel plenum and through the downstream plate, each tube of the second plurality of tubes having a fuel port in fluid communication with the fuel plenum, an inlet defined proximate to the upstream surface and an outlet defined at a downstream end of each tube of the second plurality of tubes;

wherein the downstream end of one or more tubes of the first plurality of tubes is axially offset from the downstream end of one or more tubes of the second plurality of tubes with respect to the axial centerline of the end cap assembly; and wherein at least one tube of the first plurality of tubes converges radially inwardly between the downstream surface and the downstream end of the at least one tube of the first plurality of tubes, wherein the downstream end of at least one tube of the second plurality of tubes has a first portion and a second portion, wherein the second portion converges radially inwardly between the downstream surface and the downstream end of the at least one tube of the second plurality of tubes along an axial centerline of the at least one tube of the second plurality of tubes while the first portion extends axially along the axial centerline of the at least one tube of the second plurality of tubes.

10. The gas turbine as in claim 9, further comprising a third tube having an outlet defined at a downstream end of the third tube, wherein the downstream end of the third tube terminates at the downstream surface and the downstream end of one or more tubes of the first plurality of tubes terminates at a point that is axially offset from the downstream surface.

11. The gas turbine as in claim 9, wherein the downstream end of one or more of the tubes of the first plurality of tubes and the downstream end of one or more tubes of the second plurality of tubes are axially offset from the downstream surface.

12. The gas turbine as in claim 9, wherein a downstream end of at least one tube but not all tubes of the first plurality tubes has a first portion and a second portion, wherein, the first portion is axially offset from the second portion, and wherein a downstream end of at least one tube but not all tubes of the second plurality tubes has a first portion and a second portion, wherein the first portion at least one tube of the second plurality tubes is axially offset from the second portion at least one tube of the second plurality tubes.

13. The gas turbine as in claim 9, wherein a downstream end of at least one tube but not all tubes of the first plurality of tubes has a first portion and a second portion, wherein the first portion is axially offset from the second portion to form a stepped outlet at the downstream end of the at least one tube of the first plurality of tubes.

14. The gas turbine as in claim 9, wherein a downstream end of at least one tube but not all tubes of the second plurality of tubes has a first portion and a second portion, wherein the first portion is axially offset from the second portion to form a stepped outlet at the downstream end of the at least one tube of the second plurality of tubes.

15. The gas turbine as in claim 9, wherein at least one tube but not all tubes of the first plurality of tubes converges radially inwardly between the downstream surface and the downstream end of the at least one tube of the first plurality of tubes and wherein at least one tube but not all tubes of the second plurality of tubes converges radially inwardly between the downstream surface and the downstream end of the at least one tube of the second plurality of tubes.

* * * * *